US006429581B1

(12) United States Patent
Trentelman

(10) Patent No.: US 6,429,581 B1
(45) Date of Patent: Aug. 6, 2002

(54) TIR LENS FOR UNIFORM BRIGHTNESS

(75) Inventor: Jackson P. Trentelman, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/394,297

(22) Filed: Sep. 10, 1999

Related U.S. Application Data

(60) Provisional application No. 60/099,726, filed on Sep. 10, 1998.

(51) Int. Cl.[7] ..... H01J 17/00

(52) U.S. Cl. ..... 313/493; 313/573; 313/113; 313/317

(58) Field of Search ..... 126/699; 313/493, 313/573, 113, 111, 114; 362/338, 334, 337

(56) References Cited

U.S. PATENT DOCUMENTS

| | | | | |
|---|---|---|---|---|
| 4,337,759 A | | 7/1982 | Popovich et al. | 126/438 |
| 5,233,262 A | * | 8/1993 | Lynn et al. | 313/113 |
| 5,404,869 A | | 4/1995 | Parkyn, Jr. et al. | 126/699 |
| 5,408,395 A | * | 4/1995 | Schmid et al. | 362/240 |
| 5,577,493 A | | 11/1996 | Parkyn, Jr. et al. | 126/699 |
| 5,613,769 A | | 3/1997 | Parkyn, Jr. et al. | 362/338 |
| 5,834,889 A | * | 11/1998 | Ge | 313/493 |
| 5,858,046 A | | 1/1999 | Allen et al. | 65/66 |
| 6,198,213 B1 | * | 3/2001 | Trentelman | 313/493 |

* cited by examiner

*Primary Examiner*—Vip Patel
*Assistant Examiner*—Ken Berck
(74) *Attorney, Agent, or Firm*—Anca C. Gheorghiu; Angela. N. Nwaneri; Siwen Chen

(57) ABSTRACT

This invention provides a TIR (total internal reflecting) lens to capture and redirect light from multiple light sources, such as neon or fluorescent lamps, to generate a light of uniform brightness across the lens face.

12 Claims, 2 Drawing Sheets

TIR LENS FOR UNIFORM BRIGHTNESS

This application claims the benefit of U.S. Provisional Application, Serial No. 60/099,726, filed Sep. 10, 1998 entitled TIR LENS FOR UNIFORM BRIGHTNESS, by Jackson P. Trentelman.

TECHNICAL FIELD AND INDUSTRIAL APPLICABILITY OF THE INVENTION

This invention relates to radiant energy manipulation, collection, redirection and concentration. More particularly, this invention relates to the use of a totally internal reflecting (TIR) lens used to capture and redirect light from an extended light source such as a neon or fluorescent lamp.

BACKGROUND OF THE INVENTION

TIR elements are well known and have been proposed for use in a variety of applications. For example, U.S. Pat. No. 4,337,759 (Popovich et al.) describes the design and use of TIR lenses for various technologies including photovoltaic cells, thermoelectric cells, thin films, lasers, photochemical, solar power and other means which use radiant energy. Further, U.S. Pat. No. 5,404,869 (Parkyn, et al) discloses improvements in the design of such lenses including the use of curved faceted TIR surfaces instead of using a flat surface for better collimation, focusing, and increased design freedom. Additionally, the '869 patent discloses a lens that redirects light from the source onto a spot in front of the lens giving more efficient focusing and brightness.

One of the asserted uses of such a lens is in conjunction with an aspheric lens for elimination of some illumination non-uniformity typical of earlier TIR lenses, making it particularly useful in imaging projectors, light emitting diodes (LED), optical fibers, spectrophotometers, and toroidal lamp reflection in a forward orientation good for battery powered fluorescent lights.

In addition, U.S. Pat. No. 5,577,493 discloses an apparatus comprising a TIR lens plus a "light ray deviator" positioned along the light path between the source and the TIR lens, for deviating light toward portions of the lens spaced from the axis, thereby more evenly distributing light flux at the TIR lens. The improvement was thought to be useable with liquid crystal displays (LCD) to enhance the incandescent light sources ability to illuminate uniformly. Moreover, U.S. Pat. No. 5,613,769 (Parkyn et al.) discloses a TIR lens having non-circular configuration around an optical axis that is asserted to be suitable for holographic diffusers and lenticular lenslet arrays to produce tailored output intensities useful for compact LED light sources. It also discloses TIR facets in a lens increasingly separating in one arc and increasingly converging in a second arc, a lens where the perimeter is non-circular, or rectangular, or square, thus creating what is described as a"mushroom lens." Such lenses are said to provide a powerful way of controlling the light beam, with improved collimation as the result of the entire beam having the same angular spread resulting in improved propagation.

In general, although the use of TIR lenses began with efforts to concentrate light, in particular, solar energy, for various uses, developmental efforts in the field are now directed toward uses in light emitting devices and the concentration and focusing of light from low energy sources in a highly efficient manner for illumination purposes. Perhaps one of the most significant improvements exemplified by use of a TIR lens is that one can focus light from a source nearly 90 degrees from the target, whereas use of a traditional refraction based lens would limit the angle from source to target to only about 30 degrees. This development allows the design of lamps or collectors with significantly higher efficiencies.

Unfortunately, however, the prior art relating to the use of TIR lenses with a neon or fluorescent lamp are based on an array of facets which capture light from the source through one face of the facet (the entry face) and then internally reflect it off the other face, thus redirecting the light to the target zone or viewer out an exit face of the lens. In each case, the side of the facet from which the light is reflected appears bright to the target zone or viewer, while the entry face of the facet appears dark. So, for an entire circular lens surface covering a lamp, for example, the light would appear to the target zone or viewer as a series of concentric bright rings separated from each other by a series of concentric dark rings. The bright rings are the result of viewing the light leaving the TIR facet at the reflecting face and directed toward the viewer or target. The dark rings are the result of the light entering the TIR facet. Such a pattern is reminiscent of the series of light and dark lines seen as a result of passing light through a Fresnel lens. The ring effect can be lessened by increasing the number or density of facets in the TIR lens, thereby decreasing the thickness of the lines or rings, but cannot be eliminated. Any attempt to increase the facet density to compensate for this problem results in higher tooling costs and construction complexity. Further, the increased density also results in a loss of efficiency of the lens due to the increased tip effects at the point of each TIR facet.

Another problem encountered with the use of conventional TIR lenses to focus light concerns their efficiency. In order to maximize the focusing power of TIR lenses, it is necessary to construct the lens in such a manner as to catch the incident light not directly in front of the lens. This is normally accomplished by either curving or "wrapping around" the lens, and by the addition of alternate reflecting means to bounce the light from the source traveling away from the TIR lens back toward the lens. Such curvature or additional reflectors may not be desirable from a design point of view when a flat or uniformly curved lamp surface is desired.

Co-pending, co-assigned U.S. Ser. No. 09/112,564 has disclosed one approach for alleviating this problem by integrating optical elements into the lamp. The above improvements notwithstanding, there continues to be a need for a TIR lens which allows for focusing of light without creation of the alternating dark/light concentric ring pattern, and which simultaneously allows for the construction of such a TIR lens with a flat or uniformly curved surface. These needs are met by the invention described herein.

SUMMARY OF THE INVENTION

The present invention provides a TIR lens that efficiently focuses light without the creation of light/dark concentric rings, and which can be used in the form of a uniformly curved or flat surface. These two advantages are accomplished by using TIR facets which collect light from two different sources simultaneously. Consequently, from the viewer's angle, the light directed does not have concentric rings and is uniformly bright across the surface of the lens. Moreover, the lens can be manufactured so that it has either a flat, smooth or uniformly curved surface. Further, the TIR lenses of the present invention allow the light to be focused and gathered with high efficiency.

The improvements over the prior art are accomplished by each TIR facet having two reflecting faces which can capture light from two different sources; unlike the prior art facets having a reflecting and a refracting face. The angle defined by the two faces of the TIR element is dependent on the angle of the desired incident light which is being redirected, and is similar in that regard to prior art TIR elements. By appropriate selection of this angle, the brightness of the light is extended across the refractive element and both faces of the TIR facet in a uniform manner.

The improved facets are preferably used in conjunction with closely spaced radiant energy sources placed proximally to the entry faces of the lens apparatus. The radiant energy sources may be oriented either linearly (parallel to each other), circularly (toroid), or could in fact, be arbitrarily oriented with respect to the lens elements. The radiant energy sources may be mounted or otherwise disposed on a support, or they may be formed within a support substrate such as discharge channels formed in a glass substrate which is filled with a noble gas. One particularly useful method for forming a device in which the radiant energy source is formed within a support substrate is that described in co-pending, co-assigned U.S. Pat. No. 5,858,046. As described therein, such discharge channels are vacuum formed into a sheet of glass material in the desired shape or orientation, and a second sheet of a similar material applied on top of the first sheet to seal the discharge channels. The two sheets may then be sealed together by the application of heat and/or pressure. The heat may be residual heat in the glass or it may be added subsequently from an extrinsic source. Using this method, a series of parallel channels, or a continuous serpentine discharge channel, can be formed in virtually any configuration, including 3-dimensions, for containing a radiant energy source.

The TIR lens apparatus may be laid on top of, or located proximally to the support containing the radiant energy sources, and is oriented so that a single TIR facet is located between each pair of radiant energy sources, and a refractive element is located directly above each radiant energy source. In a preferred embodiment, the distance between radiant energy sources or discharge channels is equal to the distance between TIR elements, and the range of this distance is approximately from about 1 to 3 cm. This distance range is not the maximal limit, as the distance is generally a factor of the size and weight of the lens being constructed. Accordingly, it would be theoretically possible to construct a lens where the TIR elements were spaced centimeters or even hundreds of centimeters apart depending on the size of the apparatus and light sources. The limitation to the magnitude of the lens size is generally due to the weight and construction of the lens material and not as a result of an optical limitation. Further, the distance between each radiant energy source and the interposed TIR element is preferably the same. to preserve a symmetrical appearance. This arrangement will allow the TIR elements to capture and reflect the radiant energy from two different sources and redirect it across the exit face of the lens with uniform brightness.

In an alternate embodiment, the lens and the radiant energy source may be constructed out of a single piece of glass or laminate material. In this embodiment, discharge channels may be vacuum formed into one surface of a sheet having the TIR facets formed on its opposite surface such that a discharge channel is interposed between each pair of TIR facets. A second sheet of glass comprising refracting elements corresponding to the locations of the discharge channels may then be laid down on top of the formed channels opposite the TIR facets, and the two sheets then sealed together by the residual heat of formation of the first sheet and the application of pressure as needed to both sheets simultaneously. The material for this one-piece lens apparatus would preferably be made out of a non-porous transparent material, such as glass, in order to maintain the radiant energy source, e.g. a suitable noble gas, within the discharge channels of the lens.

DETAILED DESCRIPTION OF THE PREFERRED EMBODIMENTS OF THE INVENTION

Figure 1:
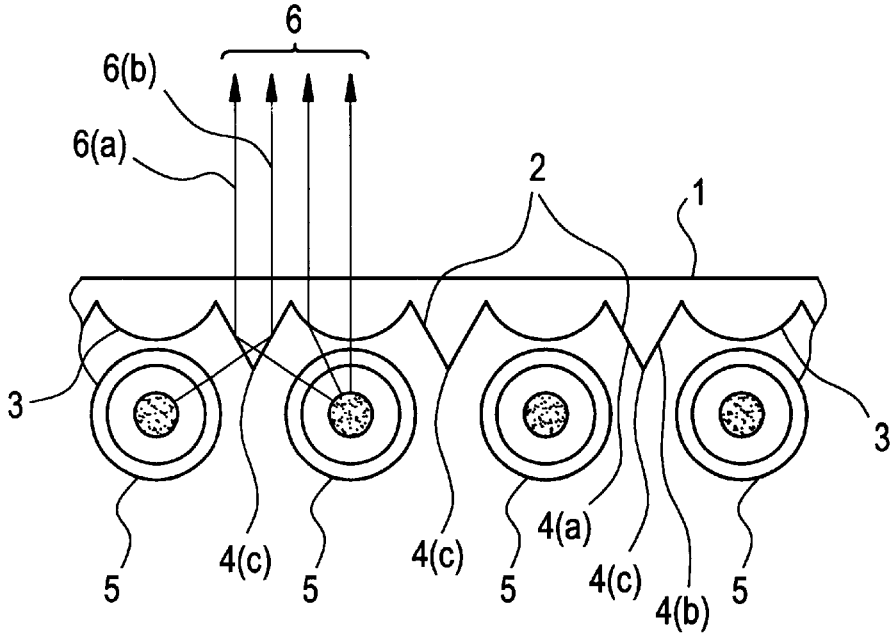
FIG. 1 is a cross-sectional view of an embodiment of the lens of the present invention and accompanying radiant energy sources.

A cross-sectional view of a preferred embodiment of the proposed TIR lens apparatus is shown in FIG. 1. The lens has an exit face I which may be smoothly curved or flat. On the reverse side of the lens body from the exit face, the lens has an entry face composed of TIR elements 2 and refractive elements 3. The TIR elements 2 may have any optically suitable cross-section, preferably a triangular cross-section which provides an outer surface composed of two entry faces 4(*a*) and 4(*b*) forming an apex 4(*c*) which allows light generated from a radiant energy source 5 proximal to and parallel with the TIR and refractive elements 2 and 3, to enter from several directions through faces 4(*a*) and 4(*b*) and refractive elements 3. Each entry face 4(*a*) and 4(*b*) of the TIR element 2 provides an internally reflecting surface for light entering the TIR element through the other entry face, and directs such light toward the exit face of the TIR lens. For example, light entering TIR element face 4(*a*) is reflected off of the reflecting surface of TIR element 4(*b*) and redirected through the exit face in a direction substantially normal to the exit face. As FIG. 1 illustrates, in operation, a portion of light 6 generated from the radiant energy sources 5 passes through the refractive element 3 and is directed thereby through the exit face of the lens apparatus in a direction substantially normal to the exit face. Simultaneously, the portions of the light (6*a*, 6*b*) entering the TIR elements from the parallel radiant energy sources (5) is reflected off the internally reflecting surface of the other face of the TIR element 4(*a*) or 4(*b*), and is directed through the exit face of the lens apparatus and out toward the viewer in a direction substantially normal to the exit face. And since the apex 4(*c*) plays an insignificant role in this process, the light will appear as a uniformly illuminated surface when viewed from the exit face of the lens apparatus. The radiant energy sources are preferably proximal to and adjacent to the refractive elements of the lens. The radiant energy sources 5 may be either self-contained light sources or light directed from a remote source. Suitable light sources are noble gas type light sources. Discharge lamps constructed from laminated glass sheets are particularly well-suited for use as the radiant energy source, since they provide inherent dimensional control as well as structural rigidity. Further, such lamps may be driven by external electrodes and provide a considerable discharge path length to create an array of parallel channels in the manner described in co-pending, co-assigned U.S. Ser. No. 60/079,198, entitled External Electrode Driven Discharge Lamp, of Trentelman. These channels may then be connected in parallel electrically, as external electrodes allow, to create a lower voltage load than that of fluorescent lighting.

The radiant energy sources are preferably placed in close proximity to the TIR lens apparatus, and are adjacent to the refractive elements thereof. Further, the distance between the radiant energy sources is preferably the same as the distance between the TIR elements, with the TIR elements disposed midway between adjacent radiant energy sources. In a particularly preferred embodiment, the distance between radiant energy sources and TIR elements is from about 1 to about 3 cm. Further, each TIR element preferably adjoins the adjacent refractive elements, and the refractive elements preferably have a width of from about 1 to about 3 cm and are spaced at a distance of from about 1 to about 3 cm apart. However, as one skilled in this art will readily recognize, the relative size, number and spacing of the TIR elements and radiant energy sources will depend on the size of the lens and intensity of the light. Further, the relative size and spacing of those elements will determine the appropriate angular orientation of the entry faces of the TIR facets.

Figure 2:
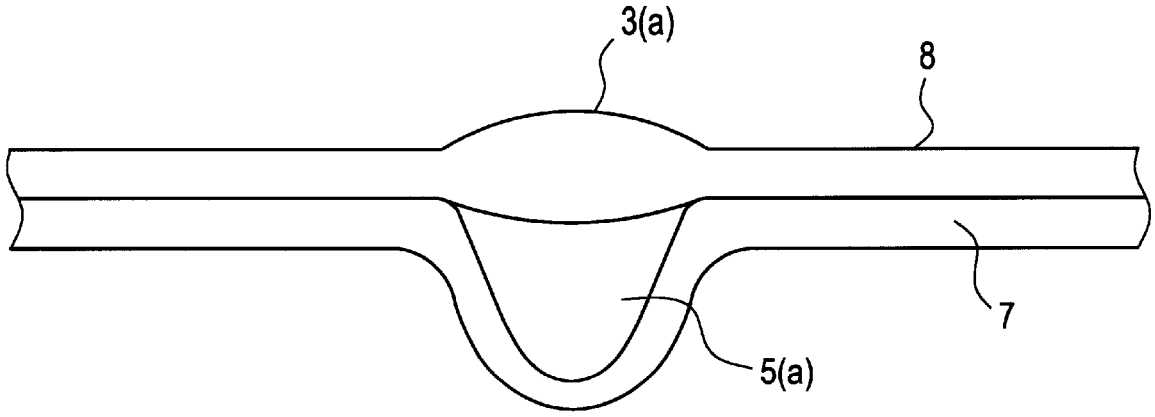
FIG. 2 is a cross-sectional view of a radiant energy source discharge channel useful in the present invention.
Figure 3:
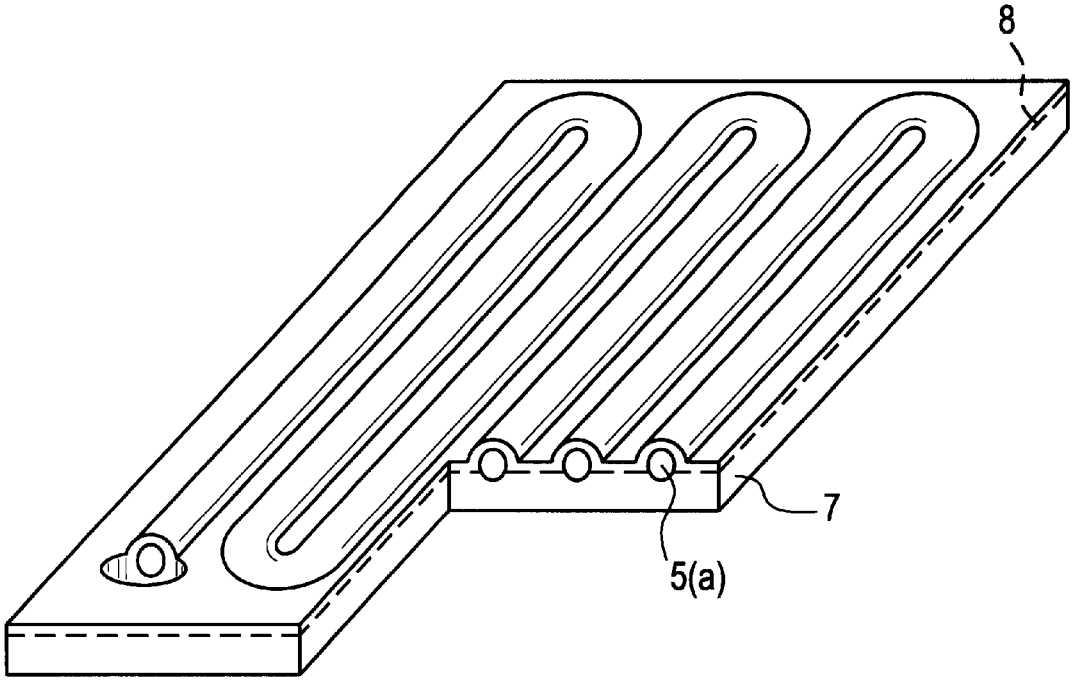
FIG. 3 is an oblique view of a serpentine radiant energy source discharge channel formed in a substrate that may be used in conjunction with the lens of the invention.

A useful embodiment of such a discharge lamp, constructed of a glass sheet, is shown in FIGS. 2 and 3. In these figures, a glass sheet 7 has a channel or depression 5(*a*) formed into the material. The channel 5(*a*) may be formed into the substrate by any conventional embossing or molding method including vacuum forming. A second sheet of a similar material 8 is then applied on top of the first sheet containing the depressions. The two sheets may then be sealed by the residual heat in the glass, or by the application of additional heat, if necessary, and the application of pressure if needed. FIG. 2 shows aspects of an alternate embodiment of the invention. In this embodiment, the second layer of glass used to seal the discharge channels has the refractive element (3*a*) of the TIR lens constructed within it so that when the two layers are sandwiched together, the second layer comprises the refractive element of the TIR lens apparatus. This embodiment is shown in greater detail in FIG. 4. As shown in FIG. 3, using this method, a continuous serpentine discharge channel for containing a radiant energy source can be formed in virtually any configuration including 3-dimensions.

Figure 4:
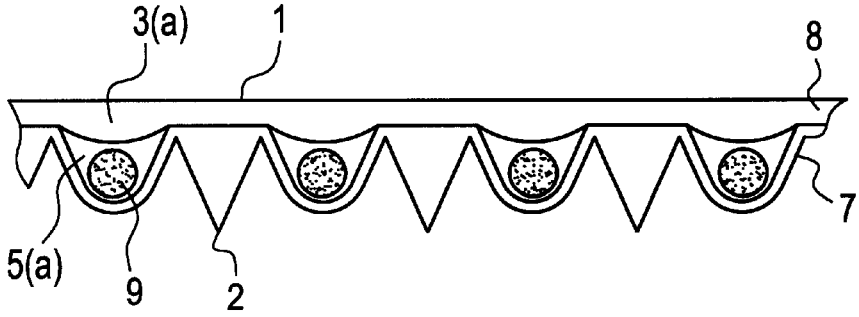
FIG. 4 is a cross-sectional view of an embodiment of the lens of the invention with built-in radiant energy source.

As FIG. 4 illustrates, by interposing a TIR element 2 between each of the discharge channels 5(*a*), the TIR lens apparatus is integrated with the radiant energy source in a one-piece design. The discharge channel may be made from two sheets 7 and 8 of glass laminated together. However, in this embodiment, the first sheet 7 contains not only the discharge channel depressions 5(*a*), but also incorporates the TIR elements 2 as well. The second sheet 8, which contains the refractive elements 3(*a*) at locations corresponding to the discharge channels 5(*a*), and which provides the exit face 1 of the lens apparatus may then be applied on top of the first sheet. The two sheets 7 and 8 may then be sealed by the residual heat in the glass and/or the application of pressure, to provide sealed channels for the containment of a suitable noble gas 9. If necessary, additional heat may be applied to the substrate to ensure a good seal.

The TIR lenses described above provide a means to focus light from low energy sources to deliver a more uniform brightness over the entire light surface, and are well-suited for use in constructing a single unit, electrically illuminated light requiring a low voltage such as a tail light, stop light, side marker light, turn signal, rear and side reflectors or other lighted fixture for installation on a vehicle having a lower framework of channel section steel. Generally, these light fixtures are made of flat or smoothly curved glass or plastic and run on only 12 volts of DC power. The sheet dimensions could be made to fit the trim of a vehicle of any shape and size. The light source could be a fluorescent tube or neon or other noble gas type light source. The lens apparatus may be made to fit behind a colored lens or could itself be colored and made to fit within such a light housing in a vehicle. The use of such a lens advantageously permits the use of less electrical power to develop a more uniform brightness over the entire light surface. Further, the housings needed for such lights could be smaller in depth and thereby provide increased mounting options.

Additionally, the more focused. and more efficient use of low wattage light provided by TIR lens apparatus makes it potentially useful for backlighting of LCD or other electro-optical or electronic displays for use in watches, computers, personal data devices and related electronic devices. An advantage in use of the present invention would be the lower electrical power usage of such a display, as well as the display having a more uniform brightness when activated, making the entire face of the display easier to read.

For example, electronic timepieces generally consist of a power source, a timepiece circuit connected to the power source to provide time information signals, and an electro-optical display device to display time information in response to the time information signals. The display usually comprises an electro-luminescent sheet composed of a transparent plate facing the lower surface of the electro-optical display device, a conducting plate spaced apart from the transparent plate, a transparent electrode secured to the lower surface of the transparent plate, an insulating layer formed on the upper surface of the conducting plate, and an electro-luminescent material filled in a space between the transparent electrode and the insulating layer. In such a device, one could position the TIR lens apparatus of FIG. 1 between the electro-luminescent material and the transparent electrode, or replace the electroluminescent material with the TIR lens apparatus of FIG. 4, which already contains the discharge lamp and lens in one unit. This use could extend to other electro-optical devices which use liquid crystal display as part of the device where the need exists to illuminate the display in low or no light conditions.

Further, due to its lower power needs and uniform illumination of the entire lens surface, the apparatus of the present invention would also be useful in creating well-lit fully illuminated signs. Such signs could advantageously exhibit the properties of lowered electrical power requirements resulting in lowered operating costs, and uniform illumination of whatever graphic indicia or design is placed onto an outer panel of the sign. Examples of such signs are well known, and include highway exit signs, storefront advertising and the like. Typically, such signs are constructed from a front panel of substantially translucent material, an opaque back panel and some means of illumination interposed between the front and rear panels. Here, the TIR lens apparatus of FIG. 1 could be used to replace the ordinary unfocused light source of the prior art signs. The radiant energy from the TIR lens apparatus and light source could be focused onto the rear surface of the front panel, causing it to glow in a more uniform manner. The amount of energy used would be lower because one can use a lower wattage light source. This effect would translate into substantial cost savings over the lifetime operation of the sign.

For the same reasons. the TIR lens apparatus of the present invention can also be advantageously used for down-lighting including, but not limited to rooms in offices, homes and other interior spaces in buildings. The principles of operation would be the same as those for the lighted sign concept. The difference would likely be in the dimensions of the panel and lens apparatus needed being in accordance with existing lighting panels. However, such uses should not be limited to present options since the TIR lens apparatus can have its light source self-contained and can have a smoothly curved surface as well as the traditional flat surface.

Although the preferred embodiments of the invention, and some of its potential uses, have been described above in detail for the purpose of illustration. it is understood that numerous variations and alterations may be made by the skilled artisan without departing from the spirit and scope of the invention defined by the following claims.

I claim:

1. A lens comprising a body having an entry face for receiving radiant energy into its interior and an exit face through which said radiant energy passes from the interior of the body to the exterior of the body, said entry face comprising a plurality of spaced parallel refractive elements and a plurality of spaced parallel TIR elements in an alternating pattern, with a single TIR element disposed between adjacent refractive elements, said TIR elements comprising a facet.

2. The lens apparatus of claim 1, wherein each TIR element adjoins the adjacent refractive elements.

3. The lens apparatus of claim 2, wherein the exit face is planar.

4. The lens apparatus of claim 2, wherein the exit face is smoothly contoured.

5. The lens apparatus of claim 2, wherein the refractive elements have a width greater than about 1 cm.

6. The lens apparatus of claim 5, wherein said refractive elements are spaced apart a distance of at least about 1 cm.

7. The lens apparatus of claim 6, wherein said refractive elements have a width of from about 1 to about 3 cm, and are spaced apart a distance of from about 1 to about 3 cm.

8. The lens apparatus of claim 1, wherein the facet exhibits a triangular cross-section with two opposing TIR faces forming an apex projecting outwardly from the lens body.

9. An illumination device, comprising:

(a) a lens comprising a body having an entry face for receiving radiant energy into its interior and an exit face through which said radiant energy passes from the interior of the body to the exterior of the body, said entry face comprising a plurality of spaced parallel refractive elements and a plurality of spaced parallel TIR elements in an alternating pattern with a single TIR element disposed between adjacent refractive elements, said TIR elements comprising a facet having a triangular cross-section with two opposing TIR faces forming an apex projecting outwardly from the lens body; and (b) a plurality of spaced parallel radiant energy sources positioned adjacent to and parallel with said refractive elements of said lens.

10. The illumination device of claim 9, wherein said radiant energy sources comprise a fluorescent tube or bulb apparatus.

11. The illumination device of claim 9, wherein said radiant energy sources comprise channels containing a noble gas that emits radiant energy when an electrical current is passed therethrough, formed within a translucent glass substrate having electrodes for passing an electrical current through said gas.

12. The illumination device of claim 9, wherein said radiant energy sources comprise parallel sections of a serpentine channel.

* * * * *